United States Patent [19]

Fraim et al.

[11] 3,963,881

[45] June 15, 1976

[54] UNIDIRECTIONAL CONDENSER MICROPHONE

[75] Inventors: Freeman W. Fraim, Lexington; Preston V. Murphy, Weston; Alan P. Woodard, Newtonville, all of Mass.

[73] Assignee: Thermo Electron Corporation, Waltham, Mass.

[22] Filed: May 29, 1973

[21] Appl. No.: 364,997

[52] U.S. Cl. ..... 179/111 E; 179/121 D

[51] Int. Cl.[2] ..... H04R 1/38; H04R 19/04

[58] Field of Search ..... 179/111 R, 111 E, 121 D, 179/1 DM, 178, 179, 180, 107 FD, 110 A, 121 R, 138 R, 146 R; 181/149, 158

[56] References Cited

UNITED STATES PATENTS

| | | | |
|---|---|---|---|
| 2,400,281 | 5/1946 | Anderson | 179/1 DM |
| 2,453,192 | 11/1948 | Bryant | 179/179 |
| 2,702,318 | 2/1955 | Dvorsky | 179/121 D |
| 3,388,767 | 6/1968 | Wilson | 179/180 |
| 3,515,240 | 6/1970 | Sugiyama et al. | 181/158 |
| 3,539,735 | 11/1970 | Marchand | 179/179 |
| 3,585,317 | 6/1971 | Dvorsky | 179/121 D |
| 3,602,332 | 8/1971 | Hollenbeck | 181/33 G |
| 3,662,124 | 5/1972 | Hassler et al. | 179/121 D |
| 3,770,560 | 11/1973 | Elder et al. | 181/33 G |
| 3,777,079 | 12/1973 | Fischer et al. | 179/121 D |
| 3,789,166 | 1/1974 | Sebesta | 179/179 |
| 3,798,390 | 3/1974 | Gage et al. | 179/107 FD |

FOREIGN PATENTS OR APPLICATIONS

| | | | |
|---|---|---|---|
| 881,584 | 11/1961 | United Kingdom | 179/111 |

OTHER PUBLICATIONS

"Elements of Acoustical Engineering," H. F. Olson, 1947, Sec. Ed., pp. 86–88, P. Van Nostrand Co., Inc., 250 Fourth Ave., N.Y. 3, N.Y.

"Applied Acoustics," Olson & Massa, 1939, Sec. Ed., p. 29, P. Blakiston's Son & Co., Inc., Philadelphia, Pa.

"Microphones," A. E. Robertson, 1963, Sec. Ed., pp. 33, 312, 313, New York Hayden Book Co., Inc. 116 W. 14th St. N.Y. 11, N.Y.

*Primary Examiner*—Kathleen H. Claffy
*Assistant Examiner*—George G. Stellar
*Attorney, Agent, or Firm*—James L. Neal

[57] ABSTRACT

A miniature unidirectional condenser microphone includes a diaphragm dividing a housing into first and second chambers. Each chamber communicates through a sound inlet port to the atmosphere. One of the sound inlet ports is covered by a sheet of porous, non-absorbent, hydrophobic thermoplastic material forming an acoustical resistance.

21 Claims, 4 Drawing Figures

UNIDIRECTIONAL CONDENSER MICROPHONE

CROSS REFERENCE TO RELATED APPLICATION

This application discloses subject matter similar to that appearing in copending Application Ser. No. 364,984, filed May 29, 1973 for Condenser Microphone in the name of Freeman W. Fraim now U.S. Pat. No. 3,895,194.

BACKGROUND OF THE INVENTION

Miniature unidirectional condenser microphones require high quality and very small acoustical resistance elements having predictable resistance characteristics. Resistance elements of porous materials are potentially advantageous from standpoints of performance, cost and ease of assembly. However, potentially useful porous elements, if manufactured in thin sheets to provide the dimensional requirements suitable for a miniaturized microphone, tend to be characterized by a non-uniform porosity per unit area. The production of multiple acoustical resistance elements of miniature size and predictably uniform acoustical resistance characteristics is thus not possible. That is, since an acoustical resistance of said materials varies across the surface of the materials, a relatively large area is required to establish a predictable acoustical resistance; if acoustical resistance elements of sizes required for miniature microphones are fabricated from such materials, the individual small elements vary in their acoustical resistance. Thus, when incorporated into microphones, they impart diverse performance characteristics.

SUMMARY OF THE INVENTION

This invention pertains to a miniature unidirectional condenser microphone having an acoustical resistance of porous thermoplastic material in thin sheet form. The porous thermoplastic material is preferably non-absorbant and hydrophobic. Such material is characterized by a consistent acoustical resistance per unit area over its entire surface. Small resistance elements all having a predictable acoustical resistance characteristic can thus be produced. Porous thermoplastic material can also be manufactured in very thin sheets so that the overall dimensions of the acoustical resistance elements produced therefrom are compatible with a miniaturized microphone.

For an acoustical resistance material of given characteristics, the total acoustical resistance provided in a given microphone is a function of the area of the porous thermoplastic material exposed to incoming sound waves. However, in the manufacture of miniature condenser microphones, it is desirable to have a sound inlet port of a size independent of the acoustical resistance characteristics of the microphone. Normally therefore application of acoustical resistance material directly over the sound inlet port is not a suitable arrangement. According to this invention, there is provided internal of the microphone a device to establish a second port having an area functionally related to the required acoustical resistance. Acoustical resistance material is applied over the second port.

DETAILED DESCRIPTION OF THE DRAWINGS

Figure 1:
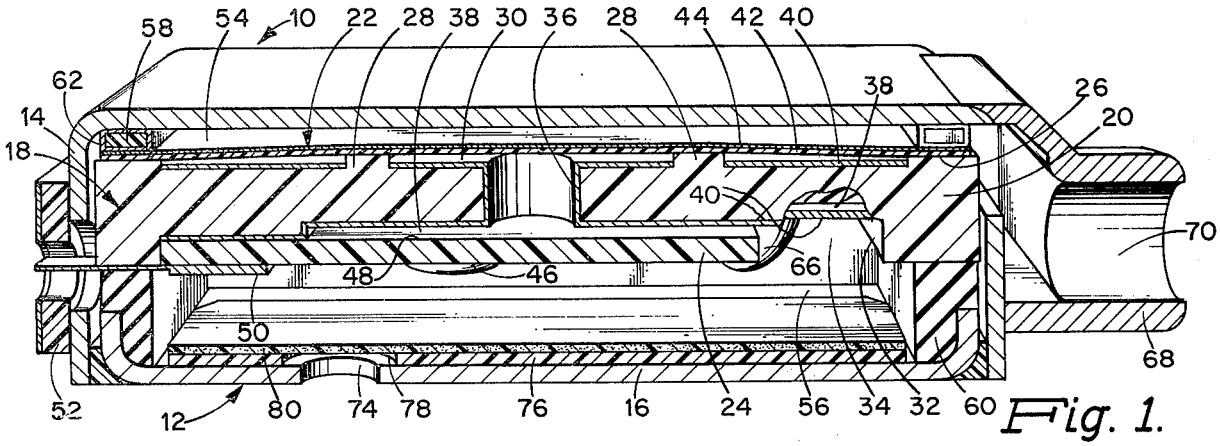
FIG. 1 is a cut-away, perspective view showing a preferred embodiment of the invention.
Figure 2:
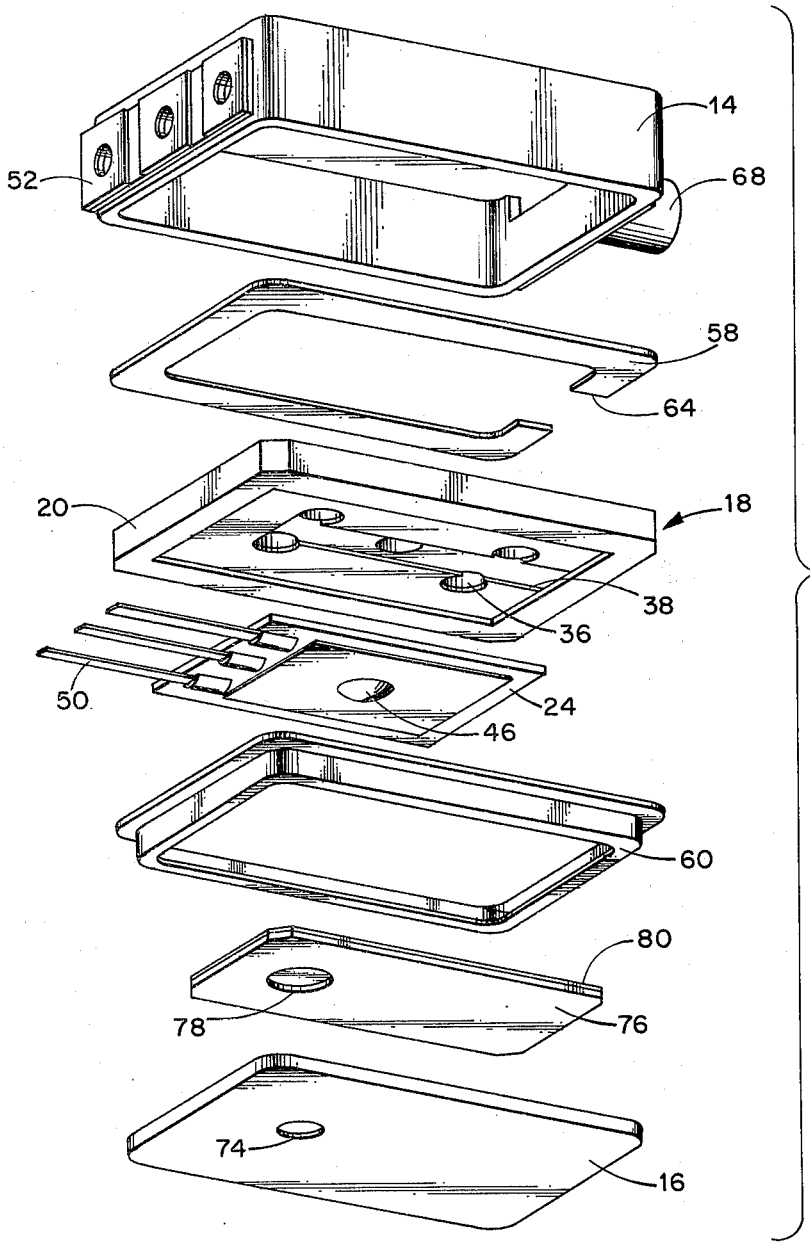
FIG. 2 is an exploded perspective view of the apparatus shown in FIG. 1.

Referring to FIGS. 1 and 2, the miniature microphone 10 incorporates a housing 12 comprised of an electrically conductive front member 14 and a rear member 16. In a preferred embodiment, the miniature housing 12 measures slightly less than 0.10 inches in thickness and has a face area of approximately 0.22 × 0.31 inches. Within the housing 10 is mounted an assembly 18 comprising a backplate 20, a diaphragm 22 and a board 24 having an electrical circuit thereon.

The backplate 20, formed of injection molded thermoplastic material, has a peripheral ridge 26 extending from an obverse face. The diaphragm 22 is mounted on the ridge 26 and spaced from the backplate by a distance equal to the height of the ridge 26. To avoid contact between the backplate and the diaphragm during operation of the microphone, a pair of posts 28 are provided. The posts approximately equal or slightly exceed the height of the ridge 26. There is formed, between the backplate and the diaphragm, a working gap 30. In the reverse side of the backplate 20 is a recess 32 for receiving the circuit board 24. The configuration of the recessed area conforms substantially to the configuration of the circuit board, except that along one portion thereof a portion of the recess 32 extends beyond the board 24 to form an open area 34. The circuit board 24 is securely bonded to the backplate 22 by an epoxy resin 66. A plurality of holes 36 extend through the backplate and communicate between the working gap 30 and the recess area 32. A system of grooves 38 in the reverse side of the backplate 20 connects the holes 36 and extends into the open area 34. The epoxy resin 66 is positioned not to block the constriction formed by the grooves 38 which connect the holes 36 with the open area 34. A thin coating 40 of electrically conductive material, such as gold, renders the backplate electrically conductive.

The diaphragm 22 comprises an electret 42 having thereon a coating 44 of electrically conductive material, such as gold. The electret is described in U.S. Pat. No. 3,612,778 titled Electret Acoustic Transducer and Method of Making. The diaphragm is mounted on the backplate by firmly securing the electret along the ridge 26 with the coating 44 facing away from the backplate 20.

The circuit board 24 is mounted in the recess 32 with the side bearing electrical components means 46 facing away from the backplate. A relatively smooth side 48 seats within the recess 34. A plurality of leads 50 extend from the circuit board for connection to a terminal board 52 mounted on the housing 12.

The assembly 18 is mounted within the housing 12 to form a first or front air chamber 54 adjacent the front housing member 14 and a rear air chamber 56 adjacent the second or rear housing member 16. The spacing is accomplished by a ring 58 and a resilient gasket 60. The ring 58 is plastic with an electrically conductive coating 62. It establishes electrical connection between the diaphragm and the front member 14. The resilient gasket 60 spaces the assembly 18 from the rear member 16 and loads the assembly so that it is pressed towards the front member 14.

Means 68 extends from the front housing member 14 to form a front sound inlet port 70, communicating with front air chamber 54 through an opening 64 in the ring 58.

During operation of the microphone, the rear air chamber 56 acts as a resonance chamber. It is in fluid communication with the working gap 30 through the holes 36 and the grooves 38. The grooves 38 and the surface 48 of the circuit board 24 form a air passageway which constitutes a constriction in the fluid communication path between the working gap 30 and the rear air chamber 56 to damp the diaphragm 22. The character of the passageway formed by the grooves 38 and the surface 48 determines the amount of damping which occurs. It will be appreciated that the size of the groove as well as its length are the fundamental parameters which may conveniently be designed to provide a desired damping action.

Figure 3:
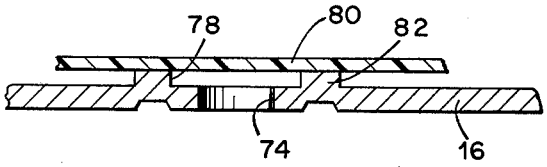
FIG. 3 shows a modification of the apparatus of FIGS. 1 and 2.

To provide the microphone 10 with unidirectional characteristics, there is in the housing member 16 a rear sound inlet port 74 which communicates with the rear air chamber 56. Mounted along the inner surface of the rear portion 16 is a spacer of sheet material 76 having an opening 78 therein. Opening 78 defines an area larger than the area of the rear port 74 and is superposed thereover. Over the spacer sheet 76, within the rear air chamber 56, a sheet of acoustical resistance material 80 covers the opening 78 and is spaced from the rear sound inlet port 74 by a distance equivalent to the thickness of the spacer sheet. Stated differently, the opening 78 and the spacer sheet 74 form a raised ridge around the inlet port 76 to define an area larger than the area of inlet port and to encompass the inlet port. Other means could be used to define this raised ridge. For example, by reference to FIG. 3, a raised dimple 82 spaces the resistance material 80 from the rear port 74 to define the opening 78. In operation of the microphone, acoustical input acts both upon the front and back of the diaphragm 22. The resistance 80 applies a delay, or phase shift, to the signal incident upon the rear of the diaphragm 22 to provide a unidirectional characteristic. Specifically the microphone 10 has a directional characteristic preferential to the front. By way of example, the unidirectional characteristic may be of cardioid configuration.

The acoustic resistance element 80 must have an acoustical resistance not less than 200 cgs ohms and not more than 5000 cgs ohms, the exact value depending upon the performance characteristic desired. One unidirectional microphone for hearing aid use has an acoustic resistance of approximately 1,000 cgs ohms. Both membranes and sintered plastics provide acceptable resistance elements. One suitable porous membrane is of themoplastic, a copolymer of acrylonitrile and polyvinylchloride on a nylon substrate. It is manufactured by Gelman Instrument Company, 600 South Wagner Road, Ann Arbor, Mich. and sold under the trade name "Acropor". For hearing aid purposes, a suitable microphone includes such a membrane having a 5 micron pore size and a membrane thickness of 0.0045 inches. Membranes having pore sizes in a range of from 3 to 10 microns at not exceeding 0.020 inches in thickness are acceptable. A thickness dimension of 0.015 inches or less is preferred. Also suitable is a polypropylene sheet 0.008 inches thick with a pore size of 10 microns, also manufactured by Gelman Instrument Company. In miniature microphones, especially those not exceeding 0.10 inch in thickness, the thickness dimension of the resistance element is highly important. To maintain a compact and durable structure, the resistance element 80 is mounted internal of the housing 12. There is available only a small space between the inner surface of the rear housing member 16 and components of the electrical circuit board 24. This distance is limited to approximately 0.020 inches.

Sintered thermoplastics such as high density polyethelene and fluorocarbons also form suitable resistance elements 80. High density polyethylenes are those having specific gravity between 0.941 and 0.965. Those having pore sizes not exceeding 70 microns are effective. Pore sizes not less than 10 microns or more than 30 microns are preferred. As with other resistance elements discussed above, thickness should not exceed 0.020 inches, a thickness of 0.015 inches or less being preferred.

All the above materials are substantially non-absorbant and hydrophobic. The non-absorbant characteristic prevents humidity and moisture induced swelling of the resistance material which blocks the pores therein. Similarly, the hydrophobic characteristic avoids filling the pores with water by wicking.

Figure 4:
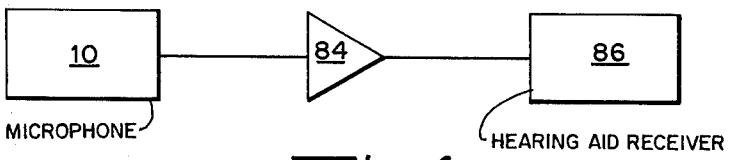
FIG. 4 is a schematic illustration showing the microphone of the present invention in combination with a hearing aid.

FIG. 4 illustrates schematically the microphone of this invention in a hearing aid. The microphone can provide an electrical output to an amplifier 84 which drives a transducer forming a hearing aid receiver 86. The unidirectional characteristic provides a hearing experience which approximates normal, unaided hearing.

This invention has been described with reference to a preferred embodiment. It will be understood by those skilled in the art that changes may be made without departing from the scope of the invention.

We claim:

1. A miniature unidirectional condenser microphone having a fore and aft orientation, said microphone comprising:

a. a miniature housing;

b. electret diaphragm means dividing said housing into front and rear chambers;

c. means in said housing forming a front sound inlet port for said front chamber;

d. means in said housing forming a rear sound inlet port for said rear chamber;

e. dimple means internal of said rear chamber projecting inwardly from the wall of said housing and surrounding said rear inlet port for defining a continuous ridge surrounding said rear inlet port and circumscribing an area larger than and including said rear inlet port; and f. sheet material supported in spaced relation to said rear inlet port by said ridge and covering the area circumscribed by said ridge for forming an acoustical resistance in the path of communication established by said rear inlet port between said rear chamber and the exterior of said housing.

2. A miniature unidirectional condenser microphone having a fore and aft orientation, said microphone comprising:

a. a housing;

b. diaphragm means dividing said housing into front and rear chambers;

c. means forming a front sound inlet port for said front chamber;

d. means forming a rear sound inlet port for said rear chamber;

e. a continuous acoustical resistance sheet of non-absorbant, hydrophobic, sound permeable material covering said rear sound inlet port and having a thickness not in excess of 0.020 inches; and f. means for rendering said sheet acoustically effective over an area thereof significantly greater than the area of said rear sound inlet port.

3. A miniature unidirectional condenser microphone according to claim 2 wherein said acoustical resistance sheet is thermoplastic.

4. In combination with the miniature unidirectional microphone of claim 2, means for electrically amplifying the output of said microphone and a receiving transducer for producing audible signals from the electrical output of said amplifying means.

5. A miniature condenser microphone according to claim 2 wherein said acoustical resistance of said sheet material is not less than 200 cgs ohms and not greater than 5000 cgs ohms.

6. A miniature condenser microphone according to claim 5 wherein said acoustical resistance of said sheet material is approximately 1000 cgs ohms.

7. A miniature condenser microphone according to claim 5 wherein said accoustical resistance sheet material comprises a porous thermoplastic membrane having a pore size not substantially less than 3 microns and not in excess of 10 microns, and having a thickness not in excess of 0.015 inches.

8. A miniature condenser microphone according to claim 7 wherein said accoustical resistance sheet material comprises a porous thermoplastic membrane having a pore size of substantially 5 microns and a thickness of substantially 0.0045 inches.

9. A miniature condenser microphone according to claim 7 wherein said accoustical resistance membrane comprises a copolymer of acrylonitrile and polyvinylchloride.

10. A miniature condenser microphone according to claim 5 wherein said acoustical resistance sheet material is sintered thermoplastic having a pore size not in excess of 70 microns.

11. A miniature condenser microphone according to claim 10 wherein said pore size is not in excess of 35 microns and said sheet thickness is not in excess of 0.015 inches.

12. A miniature condenser microphone according to claim 10 wherein said sintered thermoplastic material comprises high density polyethylene.

13. A miniature condenser microphone according to claim 10 wherein said sintered thermoplastic material comprises fluorocarbon.

14. A miniature unidirectional condenser microphone having a fore and aft orientation, said microphone comprising:

a. a miniature housing;

b. electret diaphragm means dividing said housing into front and rear chambers;

c. means in said housing forming a front sound inlet port for said front chamber;

d. means in said housing forming a rear sound inlet port for said rear chamber;

e. sheet material forming an acoustical resistance in the path of communication established by said rear inlet port between said rear chamber and the exterior of said housing; and f. second sheet material internal of said rear chamber adjacent the surface of said housing in which said rear inlet port is formed and surrounding said rear inlet port for supporting said acoustical resistance material in spaced relation to said rear inlet port, said second sheet material defining an opening having an area parallel to said acoustical resistance sheet greater than the area of said rear inlet port, said opening circumscribing and including said rear inlet port.

15. A miniature condenser microphone according to claim 1 wherein said sheet material is porous and said acoustical resistance of said sheet material is not less than 200 cgs ohms and not greater than 5000 cgs ohms.

16. A miniature condenser microphone according to claim 15 wherein said accoustical resistance sheet material comprises a porous thermoplastic membrane having a pore size not substantially less than 3 microns and not in excess of 10 microns, and having a thickness not in excess of 0.015 inches.

17. A miniature condenser microphone according to claim 16 wherein said accoustical resistance membrane comprises a copolymer of acrylonitrile and polyvinylchloride.

18. A miniature condenser microphone according to claim 15 wherein said accoustical resistance sheet material is sintered thermoplastic having a pore size not in excess of 70 microns and a thickness not in excess of 0.020 inches.

19. A miniature condenser microphone according to claim 18 wherein said sintered thermoplastic material comprises high density polyethylene.

20. A miniature condenser microphone according to claim 18 wherein said sintered thermoplastic material comprises fluorocarbon.

21. In combination with the miniature unidirectional microphone of claim 14, means for electrically amplifying the output of said microphone and a receiving transducer for producing audible signals from the electrical output of said amplifying means.

* * * * *